United States Patent [19]

Robinson, Jr. et al.

[11] 3,938,565

[45] Feb. 17, 1976

[54] FLUID DISPENSING NOZZLE INCLUDING TRIGGER RETAINING MECHANISM

[75] Inventors: George Dennis Robinson, Jr., Greensboro; Hal Craig Hartsell, Jr., Kernersville, both of N.C.

[73] Assignee: Gilbert & Barker Manufacturing Company, Greensboro, N.C.

[22] Filed: June 17, 1974

[21] Appl. No.: 480,156

[52] U.S. Cl. ..... 141/392; 141/84

[51] Int. Cl.[2] ..... B65B 3/04

[58] Field of Search ..... 141/84, 198–229, 141/392; 251/232

[56] References Cited

UNITED STATES PATENTS

| | | | |
|---|---|---|---|
| 2,113,853 | 4/1938 | Nicholson | 251/232 |
| 2,129,511 | 9/1938 | Tompkins et al. | 251/232 |
| 2,271,151 | 1/1942 | Fina et al. | 251/232 |
| 2,577,255 | 12/1951 | Logan et al. | 251/232 |
| 2,892,612 | 6/1959 | Georgieff | 251/232 |
| 2,893,419 | 7/1959 | Coulter | 251/232 |
| 3,027,909 | 4/1962 | Swain | 251/232 |
| 3,254,660 | 1/1966 | Ray | 251/232 |

*Primary Examiner*—Houston S. Bell, Jr.
*Attorney, Agent, or Firm*—Finnegan, Henderson, Farabow & Garrett

[57] ABSTRACT

A fluid dispensing nozzle, e.g., a nozzle for a gasoline station filling pump, is provided with a trigger retaining mechanism which allows an operator to retain the nozzle trigger member in its operative position by exerting a continuous relatively low manual force in contrast to the relatively high manual force required to operate the trigger member. The trigger member automatically returns to its inoperative position immediately upon release of the manual force on the trigger retaining mechanism. The fluid dispensing nozzle is particularly suitable for use in self-service gasoline filling stations.

10 Claims, 7 Drawing Figures

FLUID DISPENSING NOZZLE INCLUDING TRIGGER RETAINING MECHANISM

The present invention relates to a fluid dispensing nozzle and, more particularly, to a gasoline dispensing nozzle provided with a trigger retaining mechanism which enables an operator to easily retain its trigger member in an operative position by continuous application of a relatively low manual force.

Self-service gasoline filling stations have been placed in operation to allow automobile drivers to purchase gasoline themselves without the assistance of a service station attendant. A primary objective of self-service filling stations is to make it more convenient for drivers to fill their cars with gasoline. Self-service filling stations provide the advantage of eliminating the need to wait for an attendant to operate a gasoline filling pump. Thus, it has been contemplated that self-service filling stations will permit drivers to obtain gasoline more conveniently and with less delay than from conventional gasoline filling stations. Further, in connection with self-service stations, it has been proposed to provide automatic gasoline filling pumps operable by coins or credit cards. The use of automatic gasoline filling pumps completely eliminates the need for a service station attendant to handle cash or credit card purchases and thus further expedites the purchase of gasoline by automobile drivers.

A drawback which has discouraged more widespread use of self-service gasoline filling stations is the difficulty of inexperienced personnel to operate a conventional gasoline dispensing nozzle. Typically, a conventional gasoline dispensing nozzle includes an operating lever which requires a substantial amount of manual force to move the lever to its operative position to open the nozzle for gasoline flow. The conventional nozzle has been purposely designed to require a relatively large manual operating force to reduce the possibility of inadvertent operation of the nozzle. This design feature has made it necessary for the operator to exert a relatively large manual force on the operating lever to obtain a continuous flow of gasoline through the nozzle.

Although latching devices with automatic shutoff features have been developed in the prior art, the latching devices have been generally complex in operation and unacceptable for use in self-service filling stations by an inexperienced operator unfamiliar with the conventional gasoline dispensing nozzle. These latching devices have contributed to the difficulty of operation of the gasoline dispensing nozzle and have further discouraged use of self-service gasoline filling stations by the average driver.

Furthermore, because of the dangers associated with pumping of gasoline by inexperienced operators, some jurisdictions have declared it illegal to use any type of latching device on conventional gasoline dispensing nozzles in self-service filling stations. As a result, the driver who desires to take advantage of the convenience of self-service gasoline filling stations has been able to operate the gasoline dispensing nozzle only by continuously exerting a substantial manual force on the operating lever. Consequently, to make self-service gasoline filling stations more readily acceptable to the average driver, it is essential to provide a conveniently operated gasoline dispensing nozzle which eliminates the need for exertion of a continuous, relatively large manual force for its operation.

In addition, it is extremely desirable to provide a manually operable retaining mechanism for the trigger member of a gasoline dispensing nozzle which allows an operator to retain the trigger member in its operative position by exerting a relatively low manual force in comparison with the relatively large manual force required to move the trigger to its operative position. To comply with the legislative requirements prohibiting latching devices in self-service gasoline dispensing nozzles, the retaining mechanism must not, however, actually latch the trigger member in its operative position but must allow the trigger to return automatically to its inoperative position immediately upon release.

In accordance with the present invention, a fluid dispensing nozzle including a valve to control the flow of fluid through the nozzle is provided with a trigger member mounted on the nozzle for movement by a relatively high manual force between an inoperative position and an operative position to actuate the valve and control the fluid flow through the nozzle, and retaining means operable by a continuous relatively low manual force for holding the trigger member in its operative position. Preferably, the nozzle includes a trigger mechanism comprising a manually operable trigger member pivotally mounted on the nozzle and normally biased to an inoperative position and a manually operable trigger retaining mechanism mounted on the nozzle and operable by a continuous relatively low manual force for engaging the trigger member upon movement of the trigger member to its operative position to enable an operator to retain the trigger member in its operative position by continuous application of the relatively low manual force.

The invention provides a trigger retaining mechanism which permits adaptation of a conventional gasoline dispensing nozzle for easy operation by inexperienced personnel. The trigger retaining mechanism allows an operator to conveniently hold the trigger member of the nozzle in its operative position by merely exerting a continuous, relatively low manual force on the retaining mechanism. It thus eliminates the difficulty of operation of conventional gasoline dispensing nozzles which have previously discouraged widespread adoption of self-service gasoline filling pumps at service stations.

The accompanying drawings illustrate preferred embodiments of the present invention and, together with the description, serve to explain the principles of the invention.

Figure 1:
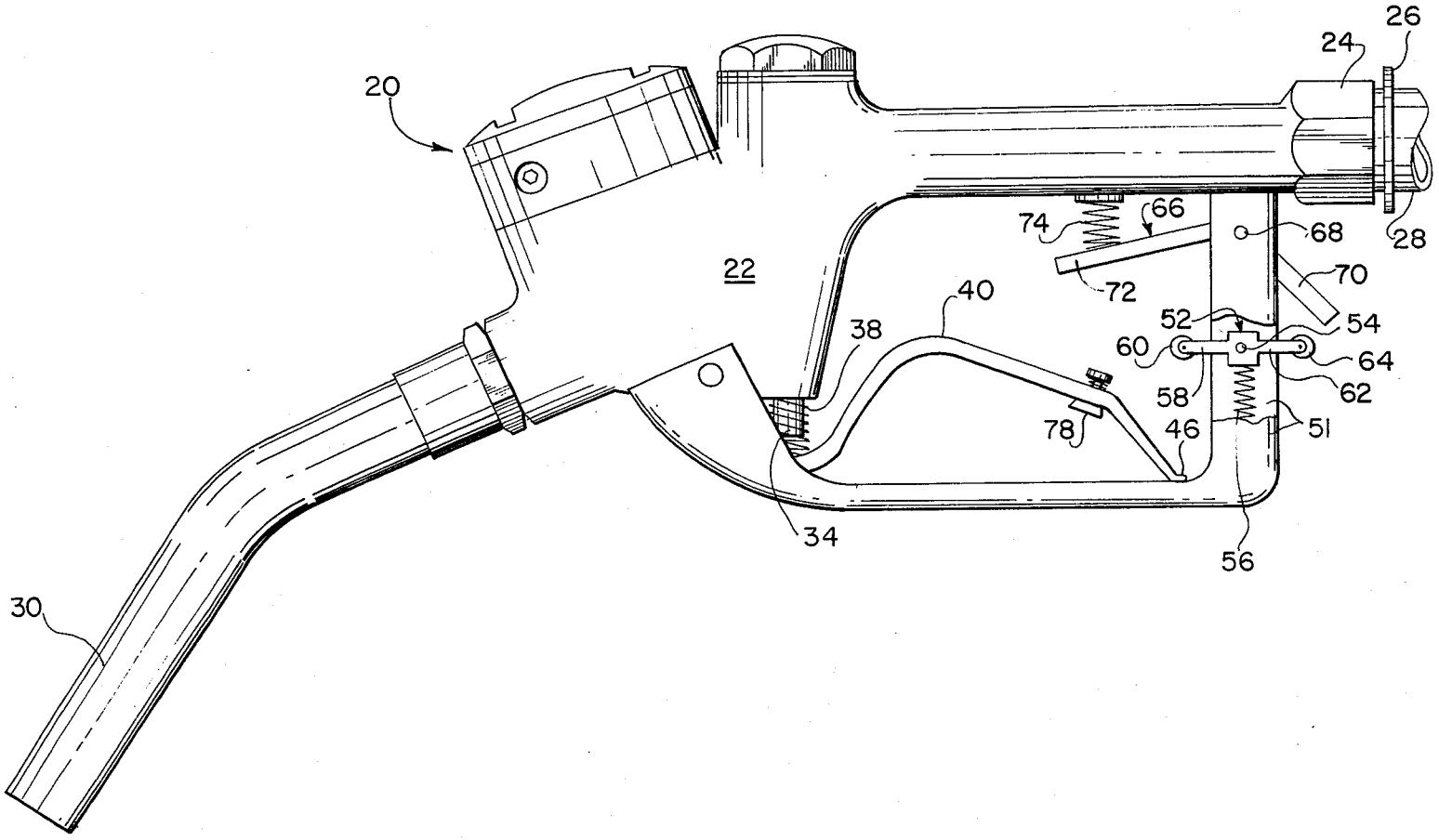
FIG. 1 is a side elevation, partially cutaway, of a gasoline dispensing nozzle incorporating a trigger retaining mechanism constructed according to the principles of the present invention.

Referring to FIG. 1, a fluid dispensing nozzle 20, e.g., a gasoline dispensing nozzle, includes a nozzle body 22 provided with an inlet passage 24 which threadably receives a bushing 26 to connect a flexible hose 28 extending from a gasoline dispensing pump (not shown). Nozzle 20 includes a discharge spout 30 from which gasoline supplied through flexible hose 28 is discharged from the nozzle. A normally closed valve, generally 32 (FIG. 2), is provided to control the flow of gasoline through the nozzle. The valve includes a displaceable actuator 34 which projects downwardly through an opening provided in nozzle body 22 and operates a valve member 36 to control gasoline flow. A strong coil spring 38 normally biases valve member 36 to a closed position.

Fluid dispensing nozzle 20 is provided with a trigger mechanism including a trigger member or operating lever 40 pivotally mounted for movement between an inoperative position and an operative position to actuate the valve and control the gasoline flow through the nozzle. A first end 42 of operating lever 40 is pivotally connected by a pin 44 to the lower end of a plunger or trip rod 45 of an automatic shutoff device located adjacent to valve actuator 34. The shutoff device is described in detail in U.S. Pat. No. 3,603,359, issued on Sept. 7, 1971, and forms no part of the present invention. Operating lever 40 extends from pivot pin 44 underneath valve actuator 34 and includes a second, free end 46 extending rearwardly away from the valve actuator. A coil spring 48 is interposed between nozzle body 22 and operating lever 40 to normally bias the operating lever downward to an inoperative position out of engagement with the valve actuator. Coil spring 48 is relatively weak in strength in comparison with coil spring 38 of the valve.

A hand or trigger guard 50 is secured to nozzle body 22 to shield operating lever 40. The rear end of trigger guard 50 is split into two spaced vertical legs 51.

Coil spring 38 of valve 32 exerts a relatively large downward bias force on valve member 36 which must be overcome upon upward movement of operating lever 40 into engagement with valve actuator 34 to operate the valve. As a result, a relatively high manual force is required to move operating lever 40 to its operative position (FIG. 2) to open the valve and permit the flow of gasoline through the nozzle.

In accordance with the invention, the fluid dispensing nozzle includes retaining means operable by a continuous relatively low manual force for holding the trigger member in its operative position. Preferably, this means comprises a manually operable trigger retaining mechanism mounted on the nozzle and operable by a continuous relatively low manual force for engaging the trigger member upon movement of the trigger member to its operative position to enable an operator to retain the trigger member in its operative position by continuous application of the relatively low manual force.

As shown in FIG. 1, the retaining mechanism is embodied as a first retaining member or rocker arm 52 supported for pivotal movement by a pivot pin 54 mounted on trigger guard 50 rearwardly of operating lever 40. The rocker arm is located between vertical legs 51 of the trigger guard. A tension spring 56 is secured to rocker arm 52 and anchored to trigger guard 50 to normally maintain the rocker arm in a horizontal orientation. A first end 58 of rocker arm 52 extends into the path of movement of free end 46 of operating lever 40 and supports a roller 60. A second end 62 of the rocker arm extends in the opposite direction and supports a roller 64.

The retaining mechanism also includes a second retaining member 66 supported for pivotal movement by a pivot pin 68 mounted on trigger guard 50 above pivot pin 54. The second retaining member is also located between vertical legs 51 of the trigger guard. Retaining member 66 includes a first arm 70 extending toward second end 62 of rocker arm 52 and a second arm 72 extending toward operating lever 40. A coil spring 74 is interposed between nozzle body 22 and second arm 72 of retaining member 66 to normally bias the retaining member into a first position out of engagement with first latching member or rocker arm 52 (FIG. 1). In this first position of second retaining member 66, its first arm 70 is biased against a stop member 76 located between vertical legs 51 of trigger guard 50 and out of engagement with roller 64 on second end 62 of the rocker arm.

A finger operated plunger 78 is mounted on operating lever 40 in alignment with the inner end of second arm 72 of retaining member 66. The plunger includes a shaft 80 slidably received in an opening 82 provided in the operating lever and an enlarged disc 84 is provided at the upper end of shaft 80. A coil spring 86 is interposed between disc 84 and operating lever 40 to normally bias plunger 78 upward relative to the operating lever.

In operation of the gasoline dispensing nozzle of FIG. 1, an operator manually grips nozzle body 22 and operating lever 40 and exerts pressure on the operating lever to raise it against the bias of coil spring 48 from its inoperative position (FIG. 1) into engagement with valve actuator 34. Further upward movement of operating lever 40 displaces valve actuator 34 and valve member 36 upward against the action of coil spring 38 to open valve 32 and allow gasoline to flow from hose 28 into inlet passage 24 and out of discharge spout 30. The gasoline flow will continue as long as operating lever 40 is held in its operative position.

During upward movement of operating lever 40, its free end 46 moves into engagement with roller 60 on first end 58 of rocker arm 52 and pivots the rocker arm in a clockwise direction about pivot pin 54 to move the roller and first end of the rocker arm out of the path of movement of the free end of the operating lever. At the same time, disc 84 of plunger 78 moves into contact with the inner end of second arm 72 of retaining member 66 to pivot the retaining member in a clockwise direction about pivot pin 68 against the action of coil spring 74 to move first arm 70 of the retaining member into alignment with roller 64 on second end 62 of rocker arm 52. When free end 46 of operating lever 40 moves out of engagement with roller 60, tension spring 56 returns rocker arm 52 to its normal, horizontal orientation with roller 64 in engagement with the lower end of arm 70. If the manual pressure on operating lever 40 is relaxed, the operating lever moves downward, primarily under the action of coil spring 38, and its free end 46 moves downward into engagement with roller 60. Thereafter, as long as the operator applies continuous manual pressure to plunger 78 to hold retaining member 66 in its second position (FIG. 2), i.e., with its first arm 70 in engagement with roller 64, rocker arm 52 is held in its normal, horizontal orientation with roller 60 in engagement with free end 46 of operating lever 40 to retain the operating lever in its operative position.

The amount of manual force required to retain retaining member 66 in its second position in engagement with first latching member or rocker arm 52 is determined by the strength of coil spring 74 and the mechanical advantage provided by arm 72 to compress the spring. The strength of coil spring 74 and the distances of the coil spring and plunger 78 from pivot pin 68 are selected so that, by exertion of a comparatively low manual force on plunger 78, in contrast to the high manual force required to move operating lever 40 to its operative position, it is possible to retain second retaining member 66 in its second position in engagement with the first latching member or rocker arm 52. Thus, the level of manual force required to retain operating lever 40 in its operative position is considerably less than the initial manual force required to move the operating lever from its inoperative position to its operative position.

When it is desired to terminate operation of the gasoline dispensing nozzle, the operator merely releases his grip on operating lever 40 and plunger 78. Coil spring 74 pivots retaining member 66 in a counter clockwise direction about pivot pin 68 to return the retaining member to its first position with its first arm 70 against stop member 76 and out of alignment with roller 64 on rocker arm 52. Simultaneously, coil spring 38 returns valve member 36 downward to its closed position and urges valve actuator 34 against first end 42 of operating lever 40 to move the operating lever downward. When valve member 36 moves into engagement with its valve seat, the downward motion of the valve member and actuator rod 34 is terminated. However, the action of coil spring 48 on the first end of operating lever 40 continues the downward movement of the operating lever until it returns to its inoperative position (FIG. 1).

During the downward movement of operating lever 40, its free end 46 engages roller 60 on rocker arm 52 and pivots the rocker arm in a counter clockwise direction about pivot pin 54 to move the roller and first end 58 of the rocker arm out of the path of movement of the free end of the operating lever. Thereafter, when free end 46 of the operating lever moves downward out of engagement with roller 60, tension spring 56 returns rocker arm 52 to its normal, horizontal orientation.

Figure 2:
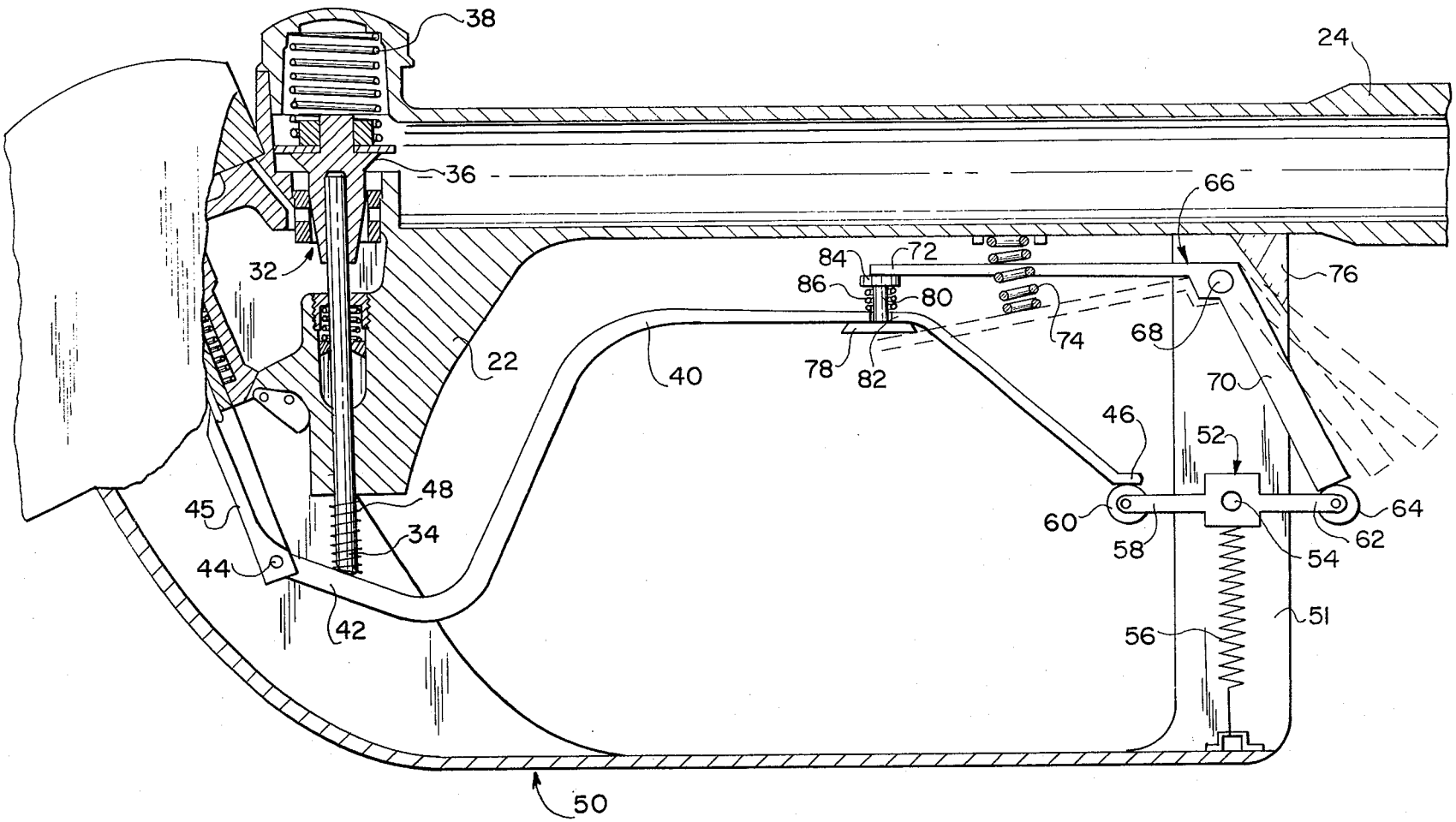
FIG. 2 is an enlarged side view, partially in section, of the gasoline dispensing nozzle of FIG. 1 illustrating the trigger retaining mechanism in its operative position.
Figure 3:
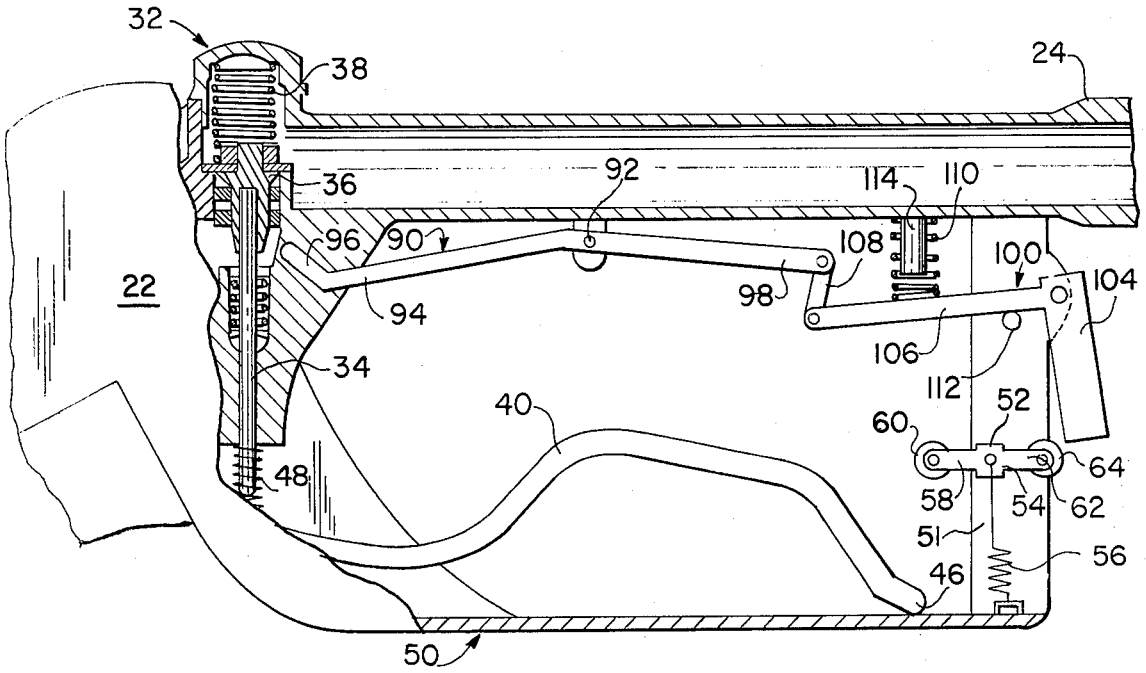
FIG. 3 is an enlarged side view, partially in section, of a portion of a gasoline dispensing nozzle, similar to the nozzle of FIG. 1, which includes an alternative embodiment of the trigger retaining mechanism.
Figure 4:
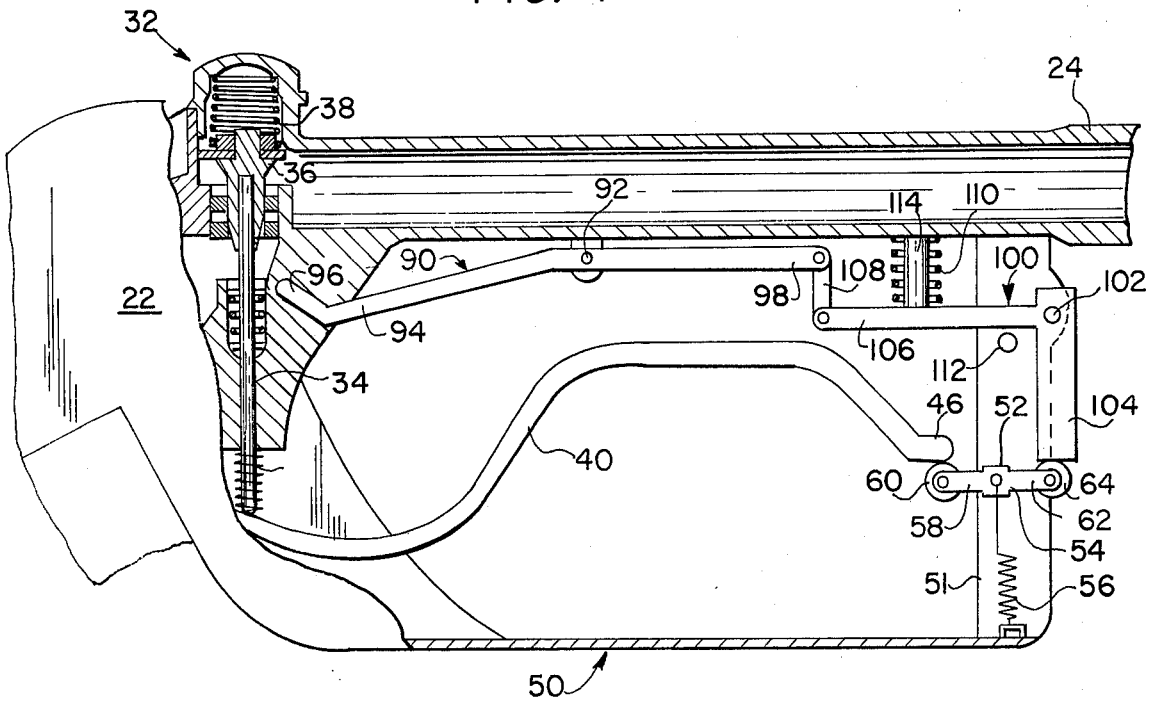
FIG. 4 is an enlarged side view, partially in section, illustrating the trigger retaining mechanism of FIG. 3 in its operative position.

FIGS. 3 and 4 illustrate an alternative embodiment of the trigger retaining mechanism including a thumb actuated linkage which allows an operator to hold the operating lever of the gasoline dispensing nozzle in its operative position. The elements of the nozzle which are identical to the corresponding elements of FIGS. 1 and 2 are identified by the same reference numerals used above.

As shown in FIG. 3, the linkage includes a thumb actuated lever 90 supported for pivotal movement by a pivot pin 92 mounted on nozzle body 22. Lever 90 includes a first end 94 which extends forwardly from pivot pin 92. A flange 96 extends laterally from first end 94 of lever 90 to allow the operator to actuate the lever with his thumb. Lever 90 also includes a second end 98 which extends rearwardly from pivot pin 92.

A retaining member 100 is supported for pivotal movement by a pivot pin 102 mounted on trigger guard 50. Retaining member 100 includes a first arm 104 extending downward toward roller 64 on first end 62 of rocker arm 52 and a second arm 106 extending in a generally horizontal direction toward operating lever 40. The inner end of arm 106 is pivotally connected to second end 98 of thumb actuated lever 90 by a link 108. A coil spring 110 is interposed between nozzle body 22 and second arm 106 of retaining member 100 to normally bias the retaining member to its first or inoperative position with its second arm 106 against a stop member 112 on the trigger guard and its first arm 104 out of alignment with roller 64. Coil spring 110 surrounds a cylindrical projection 114 provided on the nozzle body which serves as a stop for arm 106 to define the second or operative position of retaining member 100.

In the operation of the gasoline dispensing nozzle of FIGS. 3 and 4, an operator manually grips nozzle body 22 and operating lever 40 and exerts pressure on the operating lever to raise it against the bias of coil spring 48 from its inoperative position (FIG. 3) into engagement with valve actuator 34. Further upward movement of operating lever 40 displaces valve actuator 34 and valve member 36 upward against the action of coil spring 38 to open the valve and allow gasoline to flow through the nozzle. The gasoline flow will continue as long as operating lever 40 is held in its operative position.

During upward movement of operating lever 40, its free end 46 moves into engagement with roller 60 on first end 58 of rocker arm 52 and pivots the rocker arm in a clockwise direction about pivot pin 54 to move the roller and first end of the rocker arm out of the path of movement of the free end of the operating lever. When free end 46 of the operating lever moves out of engagement with roller 60, tension spring 56 turns rocker arm 52 to its normal, horizontal orientation.

The operator next applies downward pressure on flange 96 of thumb actuated lever 90 to pivot the lever in a counter clockwise direction about pivot pin 92. The pivotal movement of thumb actuated lever 90 is transmitted to retaining member 100 by link 108 to pivot the retaining member in a clockwise direction about pivot pin 102. Retaining member 100 is thus moved from its first position (FIG. 3) to its second position (FIG. 4), i.e., with second arm 106 in engagement with the lower end of projection 114 and the lower end of first arm 104 in engagement with roller 64. If the manual pressure on operating lever 40 is subsequently relaxed, the operating lever moves downward, primarily under the action of coil spring 38, and its free end is moved downward into engagement with roller 60. Thereafter, as long as the operator applies continuous manual pressure to thumb actuated lever 90 to hold retaining member 100 in its second position (FIG. 4), rocker arm 52 is held in its normal, horizontal orientation with roller 60 in engagement with free end 46 of operating lever 40 to retain the operating lever in its operative position.

The amount of manual force required to retain retaining member 100 in its second position is determined by the strength of coil spring 110 and the mechanical advantage associated with thumb actuated lever 90 and first arm 106 of retaining member 100. The strength of coil spring 110 and the mechanical advantage of the linkage are selected so that, by exertion of a comparatively low manual force with his thumb of flange 96 of lever 90, in contrast to the high manual force required to move operating lever 40 to its operative position, it is possible for an operator to hold retaining member 100 in its second position. Thus, the level of manual force required to retain operating lever 40 in its operative position is considerably less than the initial manual force required to move the operating lever from its inoperative position to its operative position.

When it is desired to terminate operation of the gasoline dispensing nozzle, the operator merely releases his grip on operating lever 40 and removes his thumb from flange 96. Coil spring 110 pivots retaining member 100 in a counter clockwise direction about pivot pin 102 to return the retaining member to its first position with its first arm 104 against stop member 112 and out of alignment with roller 64 on rocker arm 52. In addition, thumb actuated lever 90 pivots in a clockwise direction to its initial, unactuated position. Simultaneously, coil spring 38 returns valve member 36 downward to its closed position (FIG. 3) and urges valve actuator 34 against operating lever 40 to move the operating lever downward. When valve member 36 moves into engagement with its valve seat, the downward motion of the valve member and actuator rod 34 is terminated. However, the action of coil spring 48 on operating lever 40 continues the downward movement of the operating lever until it returns to its inoperative position.

During the downward movement of operating lever 40, its free end 46 engages roller 60 on rocker arm 52 and pivots the rocker arm in a counter clockwise direction about pivot pin 54 to move the roller and first end 58 of the rocker arm out of the path of movement of the free end of the operating lever. Thereafter, when free end 46 of the operating lever moves downward out of engagement with roller 60, tension spring 56 returns rocker arm 52 to its normal, horizontal orientation.

Figure 5:
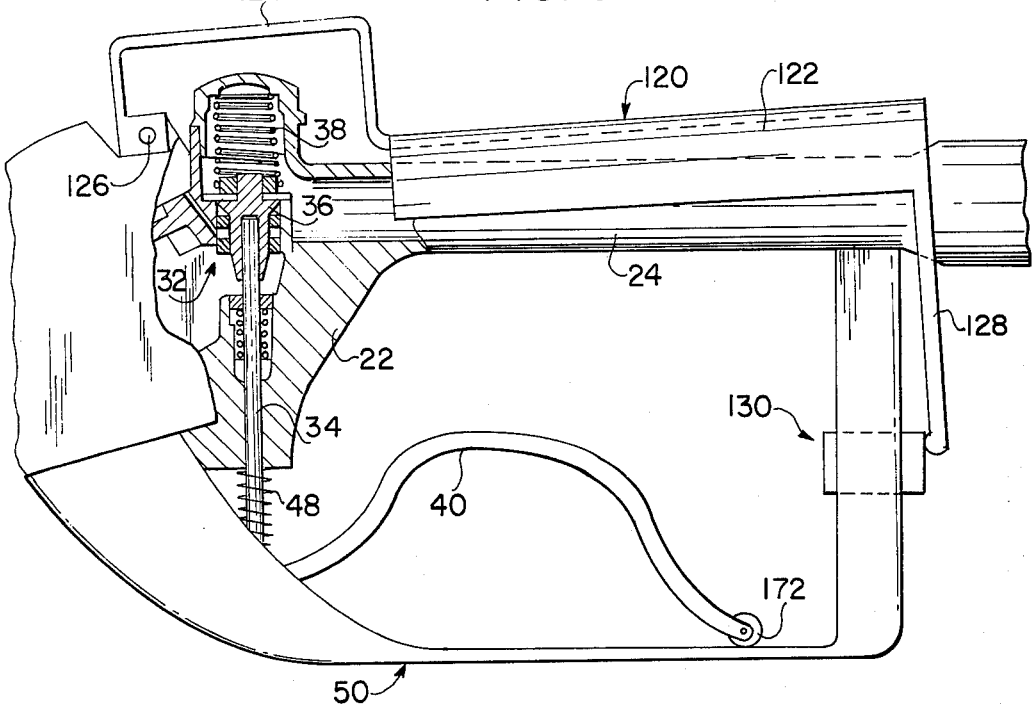
FIG. 5 is an enlarged side view, partially in section, of a gasoline dispensing nozzle including another embodiment of the trigger retaining mechanism.

FIG. 5 illustrates a gasoline dispensing nozzle including another embodiment of the trigger retaining mechanism. The elements of the nozzle which are identical to the corresponding elements of FIGS. 1 and 2 are identified by the same reference numerals used above.

As shown in FIG. 5, the retaining mechanism includes a manually operable lever 120 provided with an elongated cover-like portion 122 which conforms to the exterior of inlet passage 24 of nozzle body 22. A first arm 124 extends forwardly from cover-like portion 122 and is bent to conform to the exterior of the nozzle body around the valve. The front end of arm 124 is connected to nozzle body 22 by a pivot pin 126 to support lever 120 for pivotal movement relative to the nozzle body. A second arm 128 extends downwardly from the rear end of cover-like portion 122 of lever 120.

Figure 6:
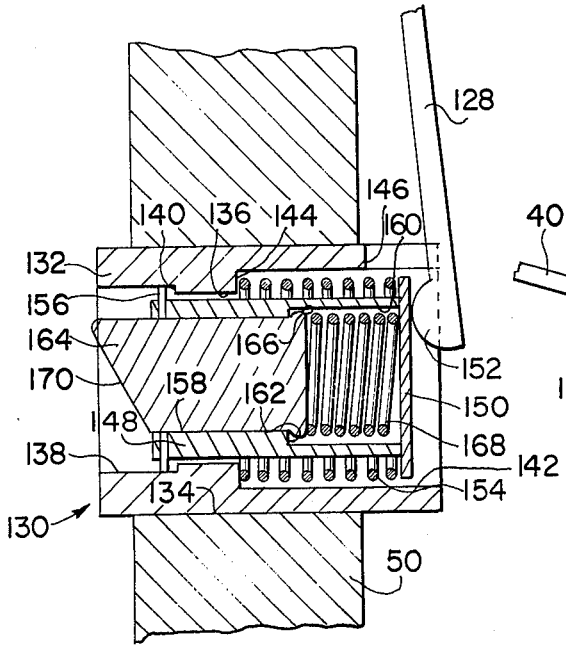
FIG. 6 is an enlarged section illustrating the trigger retaining mechanism of FIG. 5 in its inoperative position.

A plunger mechanism, generally 130, is provided on hand guard 50 adjacent to the rear, free end of operating lever 40. As shown in FIG. 6, the plunger mechanism includes a hollow, cylindrical sleeve 132 mounted in a cylindrical bore 134 provided at the rear of trigger guard 50. Sleeve 132 includes a central, cylindrical bore 136, a first, enlarged counterbore 138 extending inwardly from its front end to define an annular shoulder 140, and a second, enlarged counterbore 142 extending inwardly from its rear end to define an annular shoulder 144. The rear end of sleeve 132 extends outwardly beyond the rear edge of trigger guard 50. A slot 146 is provided at the top of sleeve 132 to allow second arm 128 of lever 120 to extend inside the sleeve.

A hollow, cylindrical support 148 is slidably received within central cylindrical bore 136 of sleeve 132. A circular plate 150 is secured to the rear end of cylindrical support 148. The lower end of second arm 128 of lever 120 includes a nub 152 for engaging circular plate 150. A coil spring 154 is interposed between annular shoulder 144 and circular plate 150 to normally bias cylindrical support 148 rightward to maintain plate 150 against nub 152. A split ring 156 is received in a groove provided at the front end of cylindrical support 148. Ring 156 serves as a stop member which, in cooperation with annular shoulder 140, limits the extent of rightward movement available to cylindrical support 148.

As shown in FIG. 6, the hollow interior of cylindrical support 148 includes a central cylindrical bore 158 extending inwardly from the front end of the cylindrical support. An enlarged counterbore 160 extends inwardly from the rear end of cylindrical support 148 to define an interior annular shoulder 162.

A generally cylindrical plunger 164 is slidably received within cylindrical bore 158 of support 158. Plunger 164 includes an annular flange 166 extending laterally from its rear end. A coil spring 168 is interposed between plate 150 and the rear end of plunger 164 to normally bias the plunger leftward with its flange 166 in engagement with annular shoulder 162. The front end of plunger 164 is provided with an inclined cam surface 170. The free end of operating lever 40 is provided with a roller 172 which, as explained below, operates in cooperation with plunger mechanism 130 to retain the operating lever in its operative position.

Preferably, a keying arrangement (not shown) is provided to prevent rotation of cylindrical plunger 164 about its axis relative to cylindrical support 148. For example, plunger 164 can be flattened on one side and a corresponding flat surface can be provided in bore 158 of the support to prohibit relative rotation. Similarly, another keying arrangement (not shown) may be provided to prevent rotation of cylindrical support 148 relative to sleeve 132.

Figure 7:
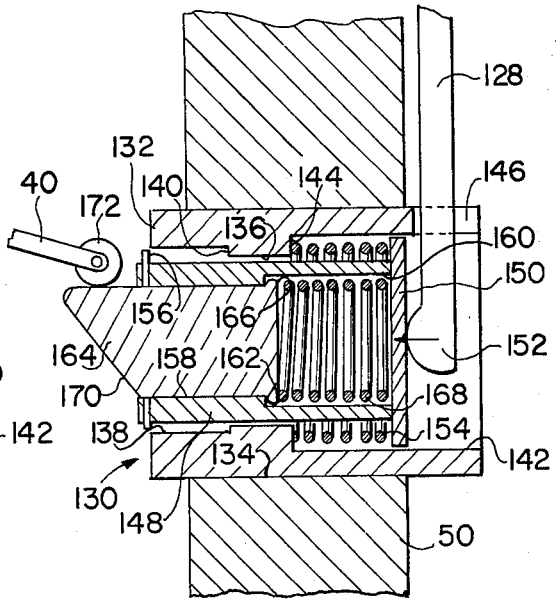
FIG. 7 is an enlarged section illustrating the trigger retaining mechanism of FIG. 5 in its operative position.

In operation of the gasoline dispensing nozzle of FIG. 5, an operator manually grips the nozzle around inlet passage 24 and applies manual pressure simultaneously to operating lever 40 and lever 120. Operating lever 40 moves upward from its inoperative position (FIG. 5) to its operative position to displace valve actuator 34 upward to open valve 32 and allow gasoline to flow from hose 28 into inlet passage 24 and out of discharge spout 30. Simultaneously, lever 120 pivots downward in a clockwise direction about pivot pin 126 to move its second arm 128 downward and leftward relative to sleeve 132 to move cylindrical support 148 leftward against the action of coil spring 154. As shown in FIG. 7, the front end of plunger 164 is thus moved into the path of movement of the free end of operating lever 40.

If operating lever 40 moves upward to its operative position prior to the inward movement of plunger 164, the plunger merely moves underneath roller 172 by virtue of the leftward movement of cylindrical support 148. If, on the other hand, plunger 164 moves into the path of movement of the free end of operating lever 40 prior to movement of the operating lever to its operative position, roller 172 engages inclined cam surface 170 to move the plunger rightward against the action of coil spring 168 to allow the plunger to be displaced out of the path of movement during further upward movement of operating lever 40. When operating lever 40 is moved upward to its operative position with roller 172 out of engagement with inclined cam surface 170, coil spring 168 returns the plunger leftward underneath roller 172. The strength of coil spring 168 is selected to allow plunger 164 to be easily displaced during the upward movement of the operating lever.

With plunger 164 located beneath roller 172 at the free end of operating lever 40, the operator can release the pressure on the operating lever and maintain it in its operative position by exerting the relatively low manual force on lever 120 to maintain plunger 164 beneath roller 172. The amount of force required to maintain the plunger in its retaining position is determined by the strength of coil spring 154 and the mechanical advantage provided by lever 120. The strength of coil spring 154 and the lengths of lever 120 and arm 128 relative to pivot point 126 are selected to require only a relatively low manual force, in contrast to the relatively high manual force required to move operating lever 40 to its operative position, to maintain the plunger in its retaining position to hold the operating lever in its operative position. Thereafter, when it is desired to terminate operation of the gasoline dispensing nozzle, the operator merely relaxes the pressure on lever 120. Coil spring 154 moves cylindrical support 148 rightward to return plunger 164 to its non-latching position out of engagement with roller 172 on the free end of operating lever 40. The operating lever returns downward under the action of coil springs 38 and 48 to its inoperative position to close the valve.

Each of the embodiments of the present invention provides a trigger retaining mechanism for a gasoline dispensing nozzle which eliminates the requirements for an operator to continuously exert a substantial manual force on the trigger member to operate the nozzle. Although a relatively high level force is required for initial movement of the trigger member to its operative position, the trigger retaining mechanism permits the operator to retain the trigger member in its operative position by merely exerting a continuous, substantially reduced manual force. Thus, the trigger retaining mechanism is particularly desirable for use in connection with self-service gasoline filling pumps to enhance the appeal of self-service filling stations to the average automobile driver.

The invention in its broader aspects is not limited to the specific details shown and described, and modifications may be made in the details of the disclosed embodiments of the trigger retaining mechanism without departing from the principles of the present invention.

What is claimed is:

1. In combination with a manually operable fluid dispensing nozzle including a valve to control the flow of fluid through the nozzle:

a trigger member mounted on the nozzle for movement by a relatively high manual force between an inoperative position and an operative position to actuate the valve and control the fluid flow through the nozzle; and retaining means operable by a continuous relatively low manual force for holding said trigger member in its operative position and for automatically releasing said trigger member for return to its inoperative position upon termination of the relatively low manual force.

2. In combination with a manually operable gasoline dispensing nozzle including a valve to control the flow of gasoline through the nozzle:

a manually operable trigger member pivotally mounted on the nozzle and normally biased to an inoperative position, said trigger member being movable by a relatively high manual force to an operative position to actuate the valve and control the flow of gasoline through the nozzle; and a manually operable trigger retaining mechanism mounted on the nozzle and operable by a continuous relatively low manual force for engaging said trigger member upon movement of said trigger member to its operative position to enable an operator to retain said trigger member in its operative position by continuous application of the relatively low manual force and for automatically releasing said trigger member for return to its inoperative position upon termination of the relatively low manual force.

3. A manually operable gasoline dispensing nozzle provided with a normally closed valve to control the flow of gasoline through the nozzle, including:

a manually operable lever pivotally mounted on the nozzle for operating the valve, said lever being normally biased to an inoperative position and movable by a relatively high manual force to an operative position to open the valve and allow flow of gasoline through the nozzle;

a first retaining member pivotally mounted on the nozzle for engaging said lever in its operative position; and a second retaining member mounted on the nozzle and manually operable by a relatively low manual force upon movement of said lever to its operative position for holding said first retaining member in engagement with said lever to prevent return movement of said lever to its inoperative position during continuous application of the relatively low manual force to said second retaining member.

4. A trigger mechanism for a manually operable gasoline dispensing nozzle including a normally closed valve provided with a displaceable actuator to control the flow of gasoline through the nozzle; comprising:

an operating lever including a first end pivotally mounted on the nozzle adjacent to the valve actuator and a second, free end extending away from the valve actuator, said operating lever being normally biased to an inoperative position out of engagement with the valve actuator and movable by a relatively high manual force to an operative position into engagement with the valve actuator to open the valve and permit the flow of gasoline through the nozzle;

an arm pivotally mounted on the nozzle and engageable with said free end of said operating lever upon movement of said operating lever to its operative position; and a manually operable retaining member being normally biased to a first position out of engagement with said arm and movable by a relatively low manual force to a second position in engagement with said arm to enable an operator to hold said arm in engagement with said free end of said operating lever to retain said operating lever in its operative position by continuous application of the relatively low manual force to said retaining member.

5. The trigger mechanism of claim 4, wherein:

said arm includes a first end extending into the path of movement of said free end of said operating lever and a second arm extending in the opposite direction; and said retaining member is pivotally mounted on the nozzle adjacent to said arm and normally biased to a first position out of engagement with said second end of said arm, said retaining member being manually movable to a second position in engagement with said second end of said arm by a relatively low manual force upon movement of said operating lever to its operative position to hold said first end of said arm in engagement with said free end of said operating lever to retain said operating lever in its operative position during continuous application of the relatively low manual force to said retaining member.

6. The trigger mechanism of claim 5, which includes:

a plunger mounted on said lever and movable into engagement with said retaining member upon movement of said operating lever to its operative position to enable an operator to hold said retaining member in its second position to retain said operating lever in its operative position by application of the relatively low manual force to said plunger.

7. The trigger mechanism of claim 5, which includes:

a thumb actuated lever pivotally mounted on the nozzle above said operating lever, said thumb actuated lever including a first end provided with a thumb engageable portion and a second end connected to said retaining member to enable an operator to hold said retaining member in its second position to retain said operating lever to its operative position by application of the relatively low manual force to said thumb engageable portion.

8. A trigger mechanism for a manually operable gasoline dispensing nozzle including a normally closed valve provided with a displaceable actuator to control the flow of gasoline through the nozzle, comprising:

an operating lever including a first end pivotally mounted on the nozzle adjacent to the valve actutator and a second, free end extending away from the valve actuator, said operating lever being normally biased to an inoperative position out of engagement with the valve actuator and movable by a relatively high manual force to an operative position into engagement with the valve actuator to operate the valve and control the flow of gasoline through the nozzle;

a plunger mechanism mounted on the nozzle adjacent to said free end of said operating lever and including a slidable plunger normally biased to a first position away from said free end of said lever and movable to a second position located in the path of movement of said free end of said operating lever; and a plunger actuating lever pivotally mounted on the nozzle and operable by a relatively low manual force for moving said plunger into the path of movement of said free end of said operating lever to enable an operator to retain said operating lever in its operative position by continuous application of the relatively low manual force to said plunger actuating lever.

9. The trigger mechanism of claim 8, wherein said plunger mechanism includes:

a hollow cylindrical support slidably mounted on the nozzle adjacent to said free end of said operating lever for supporting said plunger therein for slidable movement relative to said support;

first spring bias means for normally biasing said support away from said free end of said operating lever to maintain said plunger in its first position out of the path of movement of said free end of said operating lever; and second spring bias means for normally biasing said plunger toward said free end of said operating lever to permit said plunger to be displaced out of the path of movement of said free end of said operating lever during movement of said operating lever between its inoperative position and its operative position.

10. The trigger mechanism of claim 9, wherein:

said plunger includes an inclined cam surface cooperable with said free end of said operating lever to displace said plunger out of the path of movement of said free end of said operating lever during movement of said operating lever from its inoperative position to its operative position.

* * * * *

UNITED STATES PATENT AND TRADEMARK OFFICE

CERTIFICATE OF CORRECTION

PATENT NO. : 3,938,565

DATED : February 17, 1976

INVENTOR(S) : George Dennis Robinson, Jr., et al

It is certified that error appears in the above-identified patent and that said Letters Patent are hereby corrected as shown below:

Claim 5, column 11, line 3, change "arm" to --end--.

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*